US010415758B2

(12) United States Patent
Dagan et al.

(10) Patent No.: US 10,415,758 B2
(45) Date of Patent: Sep. 17, 2019

(54) SECURING A PIPE IN A HOUSING

(71) Applicant: GAZTRANSPORT ET TECHNIGAZ, Saint Remy les Chevreuse (FR)

(72) Inventors: Kevin Dagan, Ezanville (FR); Erwan Michaut, Cachan (FR); Bertrand Bugnicourt, Dourdan (FR); Adnan Ezzarhouni, Montigny le Bretonneux (FR); Catherine Boucard, Sonchamps (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 106 days.

(21) Appl. No.: 15/737,892

(22) PCT Filed: Jul. 1, 2016

(86) PCT No.: PCT/FR2016/051679

§ 371 (c)(1),
(2) Date: Dec. 19, 2017

(87) PCT Pub. No.: WO2017/006035

PCT Pub. Date: Jan. 12, 2017

(65) Prior Publication Data

US 2018/0299071 A1 Oct. 18, 2018

(30) Foreign Application Priority Data

Jul. 3, 2015 (FR) ..... 15 56351

(51) Int. Cl.
*F17C 13/00* (2006.01)

(52) U.S. Cl.
CPC ..... *F17C 13/001* (2013.01); *F17C 13/00* (2013.01); *F17C 2201/0104* (2013.01);
(Continued)

(58) Field of Classification Search
CPC ..... F17C 13/0001; F17C 13/00; F17C 2201/0104; F17C 2201/0128;
(Continued)

(56) References Cited

U.S. PATENT DOCUMENTS 2,621,005 A * 12/1952 Turpin ..... F16F 15/067 248/575
4,204,813 A 5/1980 Tornay
2015/0184645 A1 7/2015 Johnson

FOREIGN PATENT DOCUMENTS

EP 1314927 A1 5/2003
EP 2746663 A 6/2014
(Continued)

OTHER PUBLICATIONS

International Search Report for corresponding application serial no. PCT/FR2016/051679, dated Oct. 24, 2016.

*Primary Examiner* — Jason K Niesz
(74) *Attorney, Agent, or Firm* — Notaro, Michalos & Zaccaria P.C.

(57) ABSTRACT

A securing device for securing a pipe in a housing, which has a cylindrical collar, at least three securing arms, each securing arm containing a proximal arm portion mounted on the cylindrical collar, a distal arm portion bearing a bearing pad, the bearing pad containing a bearing surface facing away from the collar and intended to collaborate with a wall of the housing in which at least one of the securing arms contains a guideway capable of translationally guiding the distal arm portion with respect to the proximal arm portion, an elastic member being coupled to the guideway so as to be able to apply a return force that pushes the distal arm portion away from the proximal arm portion.

15 Claims, 4 Drawing Sheets

(52) U.S. Cl.
CPC ..... *F17C 2201/0128* (2013.01); *F17C 2201/0157* (2013.01); *F17C 2201/052* (2013.01); *F17C 2203/03* (2013.01); *F17C 2203/0629* (2013.01); *F17C 2203/0631* (2013.01); *F17C 2205/0364* (2013.01); *F17C 2221/033* (2013.01); *F17C 2223/0161* (2013.01); *F17C 2223/033* (2013.01); *F17C 2223/047* (2013.01); *F17C 2227/0135* (2013.01); *F17C 2227/0178* (2013.01); *F17C 2260/016* (2013.01); *F17C 2270/011* (2013.01); *F17C 2270/0105* (2013.01); *F17C 2270/0121* (2013.01); *F17C 2270/0123* (2013.01); *F17C 2270/0136* (2013.01)

(58) Field of Classification Search
CPC ..... F17C 2201/0157; F17C 2201/052; F17C 2203/03; F17C 2203/0629; F17C 2203/0631; F17C 2205/0364; F17C 2221/033; F17C 2223/0161; F17C 2223/033; F17C 2223/047; F17C 2227/0135; F17C 2227/0178; F17C 2260/016; F17C 2270/0105; F17C 2270/011; F17C 2270/0121; F17C 2270/0123; F17C 2270/0136
See application file for complete search history.

(56) References Cited

FOREIGN PATENT DOCUMENTS

| | | | |
|---|---|---|---|
| JP | 2001108198 | A | 4/2001 |
| SU | 1249258 | A1 | 8/1986 |

* cited by examiner

SECURING A PIPE IN A HOUSING

TECHNICAL FIELD

The invention relates to the field of mechanical constructions used for storing and/or transporting fluids, and notably to constructions containing pipes requiring to be secured to supports, in particular in the case in which the pipe is arranged in the interior of a reservoir or of a tank and more specifically when said reservoir or said tank is likely to be subjected to wide variations in temperature in the course of its use.

TECHNOLOGICAL BACKGROUND

In membrane tank technology, the internal surfaces of a supporting structure such as the internal hull of a ship having a double hull or a shore-based storage facility are covered with a multi-layer structure containing two fine sealing membranes alternated with two layers of thermal insulation, which serve both to limit the flow of heat through the tank wall and to support the fluid-tight membranes structurally.

In order to maximize the operating performance of a suchlike tank, it is desirable to optimize the useful storage volume that it is possible to load in the tank and to unload from the tank. However, the use of an unloading pump which sucks the liquid towards the top of the tank makes it necessary to maintain a certain liquid level in the bottom of the tank, as the suction element of the pump will otherwise enter into communication with the gaseous phase, which will deactivate and/or degrade the pump. Taking account of the specific circumstances which may arise during the operation of the tank, for example under the effect of sloshing of the load caused by wave action or by an earthquake, the necessary liquid level can be minimized only with difficulty.

Publication JP2001108198 envisages the provision of a localized depression in a bottom wall of a shore-based tank exhibiting reduced dimensions with respect to said bottom tank wall. A suchlike depression constitutes a buffer reservoir known as a sump, into which the pumping pipe discharges. More specifically, the pumping pipe is secured to a lateral wall of the tank such that its bottom end is inserted into the sump. The dimensions of the sump and the insertion of the end of the pumping pipe into the sump thus enable the quantity of liquid necessary for the effective functioning of the pump to be limited and optimizes the operating performance of the tank.

However, the lower end of the pumping pipe is left loose in the sump. As a result, this end of the pumping pipe is able to behave like a pendulum in the case of a heavy swell for a tank installed in a ship or else an earthquake in the case of a tank housed in a shore-based facility. Furthermore, this free end of the pumping pipe may exhibit undesirable and repetitive movements as a result of oscillations caused by the vibrations of the pump: suchlike behavior by the free end of the pumping pipe may cause premature wear of said pumping pipe and/or of the pump.

Similar problems are prone to arise in any pipe that is likely to be subjected to forces, notably vibratory loads, in the course of its utilization.

SUMMARY

An underlying idea of the invention is to provide a device for securing a pipe in a housing, for example, such as a sump situated in a bottom wall of a fluid-tight and thermally insulating tank.

According to one embodiment, the invention provides a securing device for securing a pipe in a housing, the device containing:

- a cylindrical collar intended to be mounted on a pipe,
- at least three securing arms, each securing arm containing
  - a proximal arm portion containing a first end mounted on the cylindrical collar capable of rotation about a first axis of rotation parallel to a generatrix direction of the cylindrical collar,
  - a distal arm portion containing a first end bearing a bearing pad, the bearing pad being mounted on said first end of the distal arm portion capable of rotation about a second axis of rotation parallel to the generatrix direction of the cylindrical collar, the bearing pad containing a bearing surface facing away from the collar and intended to collaborate with a wall of the housing,
- in which at least one of said securing arms contains a guideway coupling the proximal arm portion to the distal arm portion and capable of translationally guiding the distal arm portion with respect to the proximal arm portion in an axis of displacement perpendicular to the generatrix direction of the collar,
- an elastic member being coupled to the guideway so as to be able to apply a return force that pushes the distal arm portion away from the proximal arm portion in the axis of displacement in response to a stress aimed at moving the distal arm portion closer to the proximal arm portion.

Thanks to these characterizing features, it is possible to secure the free end of a pumping pipe in a tank housing. Furthermore, a suchlike securing device does not require the modification of the housing or a fixing passing through a wall of said housing. In addition, a suchlike securing device allows a pipe to be secured in housings exhibiting different dimensions and/or shapes. Finally, a suchlike device permits the elastic cushioning of forces between the end of the pumping pipe and the housing.

According to some embodiments, a suchlike tank may contain one or a plurality of the following characterizing features.

According to one embodiment, the securing arms extend perpendicularly to the generatrix direction of the collar.

According to one embodiment, the guideway of said at least one of the securing arms contains:

- a hollow guide tube secured to a second end of one or other of the distal arm portion and the proximal arm portion, said guide tube developing in the alignment of said one of the distal arm portion and the proximal arm portion,
- a guide rod secured to a second end of the other of the distal arm portion and the proximal arm portion, the guide rod developing in the alignment of said other of the distal arm portion and the proximal arm portion, the guide rod being slidably mounted in the guide tube in the axis of displacement.

According to one embodiment, the elastic member of said at least one of the securing arms contains a plurality of elastic washers engaged on the guide rod and supported, on the one hand, on an end surface of the guide tube and, on the other hand, on an abutment surface that said other of the distal arm portion and the proximal arm portion contains.

According to one embodiment, the elastic member of said at least one of the securing arms contains a first elastic element and a second elastic element mounted in series between the distal portion and the proximal portion of said securing arm, the first elastic element exhibiting a first rigidity and the second elastic element exhibiting a second rigidity that is higher than the first rigidity. Thanks to these characterizing features, the securing arm is able to absorb different forces, the one of the elastic elements thus enabling the absorption of forces of low intensity, for example forces associated with a vibration generated by the pump, whereas the other elastic element enables the absorption of larger forces, for example associated with an earthquake or with the action of the waves on a ship in which the tank is installed.

According to one embodiment, the cylindrical collar is made from metal, the securing device containing in addition a sliding block made from a polymer material mounted on an internal face of the cylindrical collar and intended to bear against the pipe. Thanks to these characterizing features, the collar is slidably mounted on the end of the pumping pipe, and thus, in the event of a contraction of the pumping pipe, for example associated with the introduction of LG into the tank, and that of LNG, the collar remains mounted on the pumping pipe. This sliding block may be produced and secured in different ways, for example by gluing or screwing.

According to one embodiment, the internal face of the cylindrical collar exhibits a groove developing in the radial thickness of the cylindrical collar perpendicularly to the generatrix of the cylindrical collar, the sliding block being accommodated in said groove and projecting radially towards the interior beyond the internal face of the cylindrical collar.

According to one embodiment, the groove develops in an annular manner about the generatrix direction of the cylindrical collar.

According to one embodiment, the sliding block is made from high-density polyethylene or from polytetrafluoroethylene.

The bearing pad may adopt numerous forms, for example with one or a plurality of abutment surfaces, for example plane or cylindrical. According to one embodiment, the bearing pad of at least one of the securing arms contains:

- a first plane bearing surface developing in a first plane parallel to the generatrix direction of the cylindrical collar, and
- a second plane bearing surface developing in a second plane parallel to the generatrix direction of the cylindrical collar, the first plane and the second plane being secant.

According to one embodiment, the first plane and the second plane are perpendicular.

According to one embodiment, the cylindrical collar contains a first half cylinder and a second half cylinder secured together and jointly forming the cylindrical collar.

According to one embodiment, the collar contains a shoulder projecting radially towards the exterior from an external face of the cylindrical collar, each securing arm being mounted on the shoulder.

According to one embodiment, the collar contains lugs welded on the shoulder, the arms being mounted directly on said lugs of the shoulder. According to one embodiment, the lugs are directly welded on the cylindrical collar, the securing arms being mounted on said lugs.

According to one embodiment, the invention also provides a fluid-tight and insulating tank containing a housing, for example at the level of a bottom wall of the tank, said housing being open towards the interior of the tank, and a loading pipe or unloading pipe arranged in the tank, one end of the pipe being accommodated in the housing, the pipe containing in addition an above-mentioned securing device, the cylindrical collar being mounted on the end of the pipe, the bearing pad of the securing arms of said securing device bearing against a peripheral lateral wall of the housing.

According to one embodiment, the tank contains in addition a pump housed in the pipe, said pump being capable of loading or unloading a fluid respectively into or from the housing.

According to one embodiment, the tank is configured for the transport and/or the storage of liquefied natural gas.

A suchlike tank may be part of a shore-based storage facility, for example for the storage of LNG, or may be installed in a floating, coastal or deep-water structure, notably an LNG carrier, a floating storage and regasification unit (FSRU), a floating production storage and offloading unit (FPSO) and the like.

According to one embodiment, a ship for the transport of a cold liquid product contains a double hull and an above-mentioned tank disposed in the double hull.

According to one embodiment, the invention also provides a method of loading or unloading a suchlike ship, in which a cold liquid product is conveyed through insulated pipes from or towards a floating or shore-based storage facility towards or from the tank of the ship.

According to one embodiment, the invention also provides a transfer system for a cold liquid product, the system containing an above-mentioned ship, insulated pipes arranged so as to connect the tank installed in the hull of the ship to a floating or shore-based storage facility and a pump for conveying a flow of cold liquid product through the insulated pipes from or towards the floating or shore-based storage facility towards or from the tank of the ship.

Certain aspects of the invention start from the idea of securing a pipe in a housing. Certain aspects of the invention start from the idea of providing a securing device capable of being installed in housings exhibiting different dimensions and/or shapes. Certain aspects of the invention start from the idea of providing a securing device enabling the transmission of forces between the pipe and the housing to be limited.

BRIEF DESCRIPTION OF THE FIGURES

The invention will be better understood, and other aims, details, characterizing features and advantages thereof will be appreciated more clearly from a perusal of the following description of a plurality of particular embodiments of the invention, which are given solely for illustrative and non-restrictive purposes, with reference to the accompanying drawings.

DETAILED DESCRIPTION OF EMBODIMENTS

In the following description, a description is given of a securing device capable of being mounted on a pipe housed in a sump structure in the bottom wall of a tank for the storage and/or the transport of LNG. The bottom wall designates a wall, preferably of generally planar form, situated in the bottom of the tank in relation to the earth's gravitational field. Furthermore, the overall geometry of the tank may be of different types. Polyhedral geometries are the most common. A cylindrical, spherical or other geometry is also possible. Furthermore, a suchlike tank may be installed in different structures such as a double hull of a ship, a shore-based facility or the like. Likewise, a suchlike securing device may be used in any wall and in any type of tank containing a housing into which a pipe discharges.

In the following description and in the claims, the terms "lower" and "upper" are used in order to define the relative position of one element with respect to another. The term "radial" is used in the description and the claims with respect to a longitudinal axis of the pumping pipe, one element developing radially towards the exterior developing radially as it moves away from the longitudinal axis of the pumping pipe, and one element developing radially towards the interior developing radially in the direction of the longitudinal axis of the pumping pipe.

Figure 1:
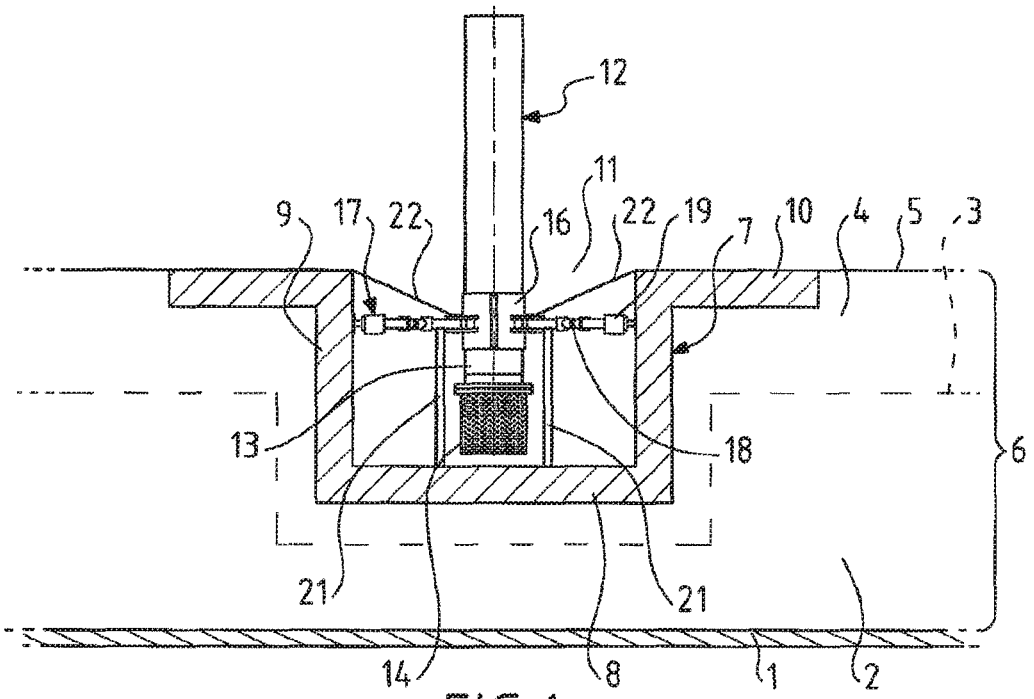
FIG. 1 represents a sectional view of a bottom wall of a fluid-tight and thermally insulating tank containing a sump structure, in which there is housed one end of a pumping pipe, a securing device being mounted on said end of the pumping pipe.

FIG. 1 represents a sectional view of a bottom wall of a fluid-tight and thermally insulating tank containing a sump structure, in which is housed an end of a pumping pipe 12, a securing device being mounted on said end of the pumping pipe.

A fluid-tight and insulating tank for the transport and the storage of LNG contains tank walls mounted on a supporting structure 1 and exhibiting a structure having multiple layers superimposed in a direction of thickness. Thus, each tank wall contains a secondary thermally insulating barrier 2, a secondary fluid-tight membrane 3 supported by the secondary thermally insulating barrier 2, a primary thermally insulating barrier 4 supported by the secondary fluid-tight membrane 3 and a primary fluid-tight membrane 5 supported by the primary thermally insulating barrier 4. This primary fluid-tight membrane 5 is intended to be in contact with a product contained in the tank, for example LNG.

The tank contains lateral walls that are connected in a fluid-tight manner to a bottom wall 6. The bottom wall 6 contains a sump structure locally interrupting the primary fluid-tight membrane 5. In a version that is not represented here, the membrane primary 5 covers the interior of the sump.

The sump structure contains a rigid container 7 arranged through the thickness of the bottom wall 6. The rigid container 7 contains a bottom wall 8 and lateral walls 9. In the example illustrated in FIG. 1, the bottom wall 8 of the rigid container 7 is situated at a lower level than the secondary fluid-tight membrane 3 in the direction of thickness of the bottom wall 6 of the tank. The lateral walls 9 are connected in a fluid-tight manner to the bottom wall 8 of the rigid container 7 in such a way as to be closed by the bottom wall 8 of the rigid container 7. These lateral walls 9 extend towards the interior of the tank from the bottom wall 8 of the rigid container 7 at least as far as the primary fluid-tight membrane 5. An upper end of the lateral walls 9 forms an edge 10 connected in a fluid-tight manner to the primary fluid-tight membrane 5. The rigid container 7 exhibits an opening 11 situated on the other side of the bottom wall 8 of the rigid container 7 and discharging into the interior of the tank.

A suchlike sump thus forms a bottom point of the tank occupying a reduced surface at the bottom of the tank, which makes it possible to reduce the volume of liquid which is not able to be delivered during unloading of the tank. A pumping pipe 12 contains an end 13 housed in the rigid container 7. An unloading pump (not illustrated) is housed in the pump pipe 12. This pump is arranged in order to suck the product contained in the tank towards the top of the tank, the pump containing a suction element (not illustrated) situated at the level of the end 13 of the pumping pipe 12.

In the embodiment illustrated in FIG. 1, the end 13 of the pumping pipe 12 contains in addition a filter screen 14 limiting the risks of the suction of residues or other undesired elements by the pump during unloading of the tank.

In order to ensure the stability of the end 13 of the pumping pipe 12 in the rigid container 7, a securing device 15 is installed on said end 13 of the pumping pipe 12.

The securing device 15 illustrated in FIGS. 2 to 6 contains a cylindrical collar 16 having a shape that is complementary to the end 13 of the pumping pipe 12. This collar 16 is mounted on the end 13 of the pumping pipe 12. The securing device 15 contains in addition four securing arms 17 developing radially from the mounting collar 16. Each securing arm 17 exhibits a telescopic structure on which an elastic member 18 is arranged. Each securing arm 17 may thus exhibit radially a variable length between a retracted position and a deployed position. The elastic member 18 of each securing arm seeks to deploy said securing arm, that is to say to increase the length of said securing arm 17. Furthermore, each securing arm 17 supports, at the level of an end opposite the collar 16, a bearing pad 19 collaborating with a lateral wall 9 of the rigid container 7, in this case at the level of the corner.

Figure 2:
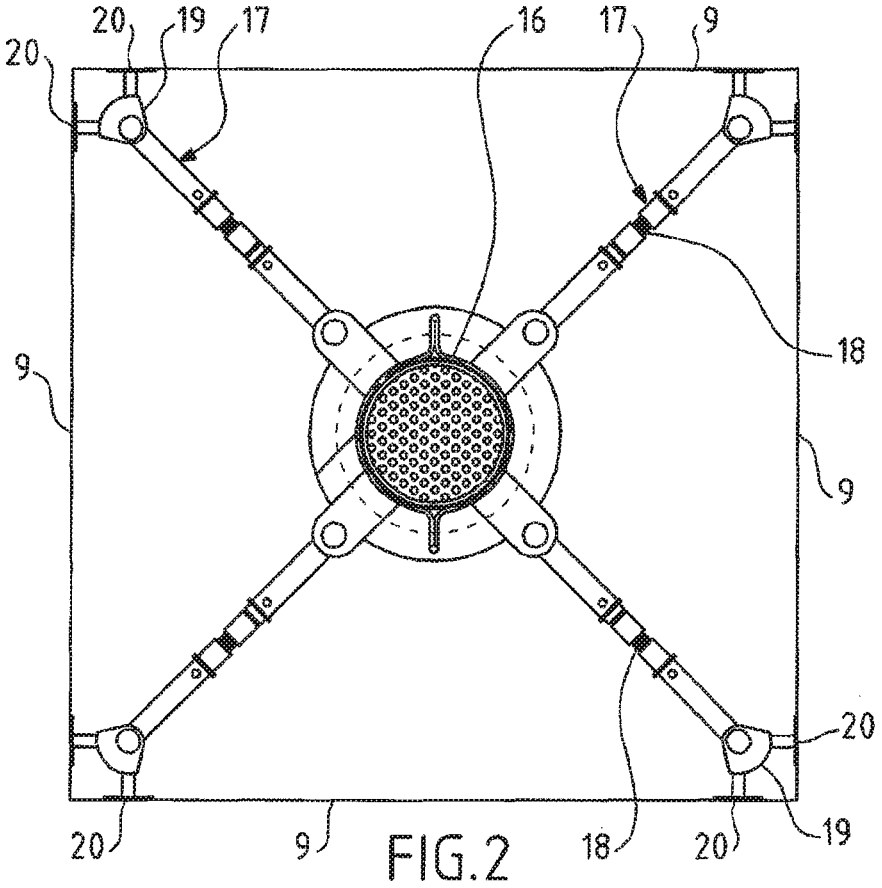
FIG. 2 is a view from above illustrating the collaboration, on the one hand between the pipe and the securing device, and on the other hand between the securing device and the walls of the sump in FIG. 1.

In the embodiment illustrated in FIG. 2, the rigid container is of square or rectangular shape and exhibits four lateral walls 9 developing in perpendicular planes. According to one embodiment, each lateral wall 9 exhibits a width of 3 m and the pumping pipe 12 exhibits a diameter of 600 mm. Each bearing pad 19 contains two abutment surfaces 20 developing in perpendicular planes. A variant that is not represented here consists in having a pad in the form of an angle iron including in an adjoined manner the two abutment surfaces 20 described above with respect to FIG. 2.

Prior to the installation of the securing device 15, the elastic members 18 are kept under pretension in order to retain the securing arms 17 in their retracted position. In this retracted position, each securing arm 17 exhibits a length smaller than the distance separating the pumping pipe from the zone of the lateral wall 9 against which it is to be supported. The securing device 15 thus exhibits dimensions that are smaller than the dimensions of the rigid container 7 and may thus be inserted easily into said rigid container 7. The prestressing of the elastic members 18 is in the order of 20 kN to 50 kN, for example. This prestressing may be produced advantageously in the factory by appropriate hydraulic means. The elastic members 18, once constrained, may be locked in this position by tie-rods which will be withdrawn during installation of the securing device 15 in the tank.

During installation of the securing device 15 on the pumping pipe 12, the collar 16 is secured in a first step to the lower end 13 of the pumping pipe 12, the securing arms 17 still being in the retracted position. The securing device is mounted on the pumping pipe 12 in such a way that each securing arm 17 develops radially from the collar 16 in the direction of an angle of the rigid container 7 formed by two adjacent lateral walls 9. Once the collar 16 has been mounted on the end 13 of the pumping pipe 12, the elastic members 18 are released in order to deploy the securing arms 17. The bearing pads 19 are then pushed back and are kept supported against the lateral walls 9 of the rigid container 7 by the elastic member 18. More specifically, with respect to FIG. 2, the abutment surfaces 20 are kept supported by the elastic member 18 against a respective lateral wall 9 forming the angle of the rigid container 7 in the direction from which the securing arm bearing develops said abutment surfaces 20. The securing arms 17, when held in this deployed position by the elastic members 18, thus enable the end 13 of the pumping pipe 12 to be secured in a stable position in the rigid container 7.

Suchlike telescopic securing arms 17 equipped with elastic members 18 permit the installation of the securing device 15 in rigid containers 7 exhibiting varied dimensions and shapes, the elastic members 18 being compressed to a greater or lesser extent, and the securing arms 17 being deployed to a greater or lesser extent according to the dimensions and shapes of the rigid container 7. Furthermore, the elastic members 18 enable forces to be absorbed between the end 13 of the pumping pipe 12 and the lateral walls 9 of the rigid container 7. In addition, suchlike securing with the help of securing arms 17 held in compression in the rigid container 7 does not require the lateral wall 9 of the rigid container 7 to be traversed in order to ensure the securing of the pumping pipe, thereby avoiding the generation of thermal bridges with the exterior of the tank. In addition, the elastic members 18 make it possible to compensate advantageously for the contraction of the material of the securing arms 17, thus permitting the secure attachment of the lower end of the pumping tank regardless of whether the tank is full of LNG at −162° C. or is empty and at ambient temperature.

Depending on the nature and the intensity of the forces to be absorbed, the securing of the pipe to the container may be envisaged solely with the help of the securing arms 17 or likewise with the help of supplementary supporting devices, as explained below with reference to FIG. 1. In the embodiment illustrated in FIG. 1, the securing device 15 in addition contains support feet 21. Each support foot 21 develops from a securing arm 17 in the direction of the bottom wall 8 of the rigid container 7. Suchlike support feet 21 assure the support of the securing device 15 in the rigid container 7 and are optional.

In the embodiment illustrated in FIG. 1, the support of the securing arms 17 is likewise assured by support cables 22. A first end of these support cables 22 is anchored on a respective securing arm 17, and a second end of these support cables 22, opposite the first end of said support cable 22, is anchored on the edge 10 of the rigid container 7. When the rigid container 7 exhibits lateral walls 9 and/or an edge 10, of which the strength does not permit the securing of the support cables 22 to be guaranteed, said support cables 22 may be anchored directly on the primary fluid-tight membrane 5. The primary fluid-tight membrane 5 may be reinforced locally at the level of the anchoring points of the support cables 22 by a laminate sheet housed beneath the primary fluid-tight membrane 5 or some other appropriate device. This system of support cables makes it possible advantageously to support a securing device of 400 kg. These support cables 22 are optional.

Figure 3:
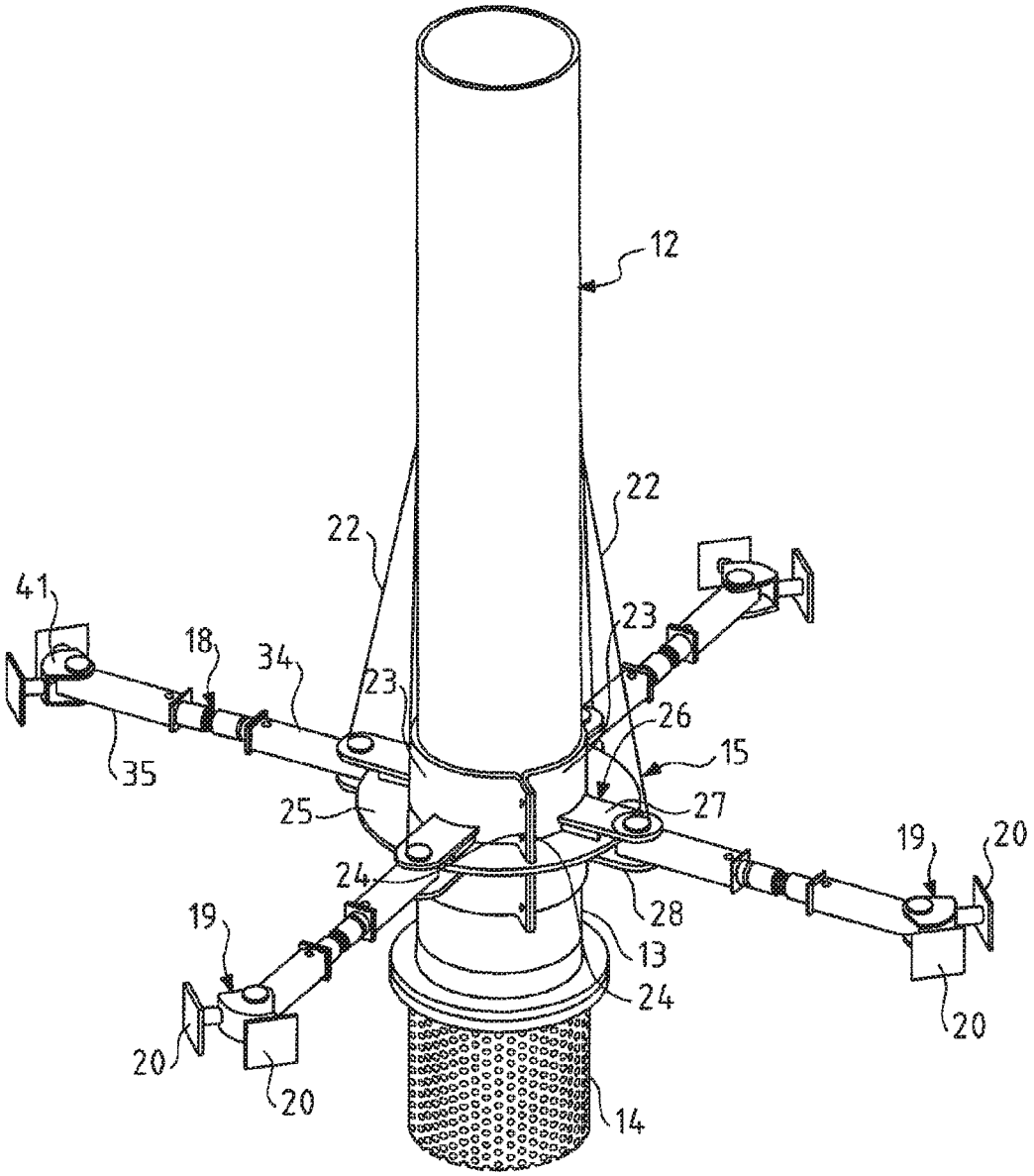
FIG. 3 is a schematic perspective view of the pumping pipe in FIG. 1 illustrating the pipe securing device mounted on said pumping pipe.

In a variant illustrated in FIG. 3, the support cables 22 are anchored on the pumping pipe 12. The support cables 22 exhibit free play allowing the contraction of the pumping pipe 12 during the insertion of LNG to be compensated for, while allowing the securing device to be kept in a secured position in the level of the sump. Thus, in the course of its installation, the securing device 15 is supported solely by the pressure of the securing arms 17 against the lateral walls 9 of the rigid container 7, and, in the course of the introduction of LNG, the thermal contraction of the element 18 no longer permits the weight of the securing device 15 to be supported and the pumping pipe 12 contracts, making it possible to tension the support cables 22 in order to support the securing device 15 without anchorage on the wall 9.

The securing device 15 is described below in more detail with respect to FIGS. 3 to 6.

FIG. 3 illustrates a schematic perspective view of the pumping pipe 12 in FIG. 1 illustrating the securing device 15 mounted on said pumping pipe 12.

The collar 16 is produced as two metallic half collars 23 in the form of circular, preferably symmetrical half cylinders. These two half collars 23 are mounted together about the end 13 of the pumping pipe 12 by any appropriate means. Thus, each half collar 23 may exhibit at one of its circumferential ends an edge 24 projecting radially towards the exterior. The edges 24 of the two half collars 23 are joined together, for example by bolting or by welding, in order to form and secure the collar 16 on the end 13 of the pumping pipe 12.

Figure 4:
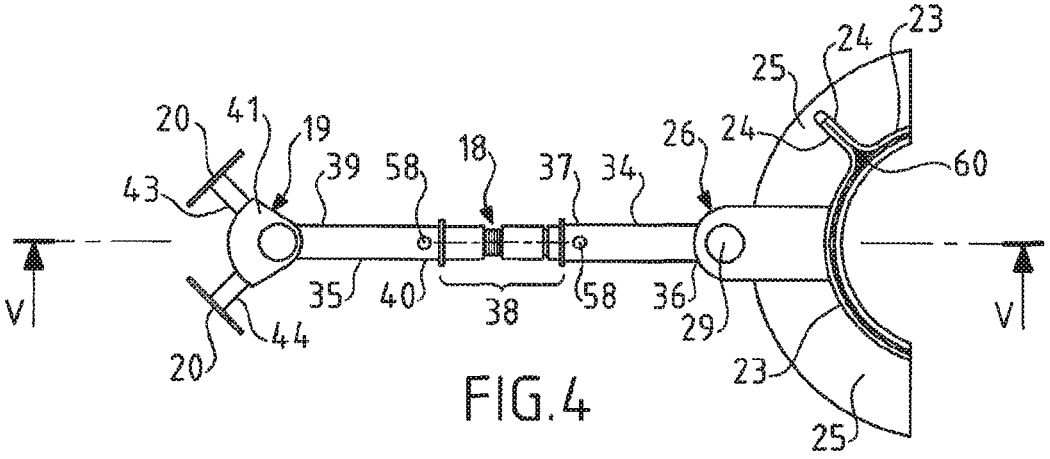
FIG. 4 is a view from above of a detail in FIG. 3 illustrating a securing arm of the securing device.

An anti-rotation system is proposed in order to lock the collar 16 in rotation on the end 13 of the pumping pipe 12. In the embodiment illustrated in FIG. 4, this anti-rotation system contains a metallic wedge 60 welded on the pumping pipe 12 and projecting radially towards the exterior from the pumping pipe 12. This wedge 60 is circumferentially interposed between the two half collars 23, for example, and, as illustrated in FIG. 4, at the level of a junction zone of the edges 24. A suchlike junction zone of the edges 24 forms a reinforcement formed jointly by the folding zones of the half collars 23 necessary for the formation of the edges 24.

Figure 11:
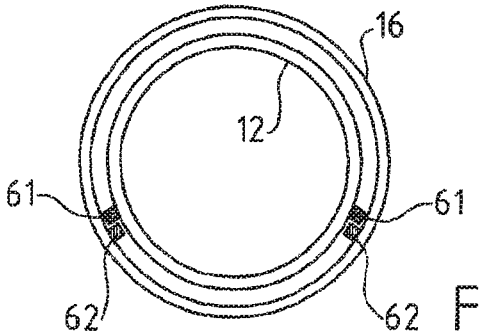
FIG. 11 illustrates a variant embodiment of an anti-rotation system blocking the rotation of the securing device on the pumping pipe.

In a variant illustrated in FIG. 11, the anti-rotation system contains two metallic wedges 61 welded on the pumping pipe 12 and two metallic wedges 62 welded on an internal face 32 of the collar 16. The metallic wedges 62 of the collar 16 are interposed circumferentially between the metallic wedges 61 of the pumping pipe 12. Each metallic wedge 62 of the collar collaborates with a metallic wedge 61 of the pumping pipe in order to form an abutment locking the collar 16 in rotation with respect to the pumping pipe 12.

A ring 25 developing in a radial plane, that is to say perpendicular to a longitudinal axis of the pumping pipe 12, is secured by welding to the collar 16. This ring 25 is preferably installed on the collar 16 after said collar 16 has been secured to the end 13 of the pumping pipe 12 in order to add rigidity to the collar 16. As a variant, each half collar 23 could contain a prefabricated half ring. This ring 25 projects radially towards the exterior from the collar 16. A plurality of lugs 26, typically one for each securing arm 17, are secured by welding on the ring 25. These lugs 26 project radially towards the exterior. Each lug 26 contains an upper plate 27 developing in a radial plane and a lower plate 28 developing in a radial plane in parallel to the upper plate 27. In a variant that is not illustrated here, the lugs 26 are directly welded on the cylindrical collar 16 or on each half collar 23.

Each securing arm 17 is rotatably mounted on a respective lug 26 about an axis of rotation parallel to a generatrix direction of the collar 16. The upper plates 27 and the lower plates 28 each exhibit an orifice in which there is mounted a pin 29 of a corresponding securing arm 17. Each securing arm 17 exhibits a certain degree of displacement in rotation about the axis of rotation defined by the pin 29. For each securing arm 17 in service, this degree of displacement is limited by the variation in the length of the elastic member 18.

Figure 5:
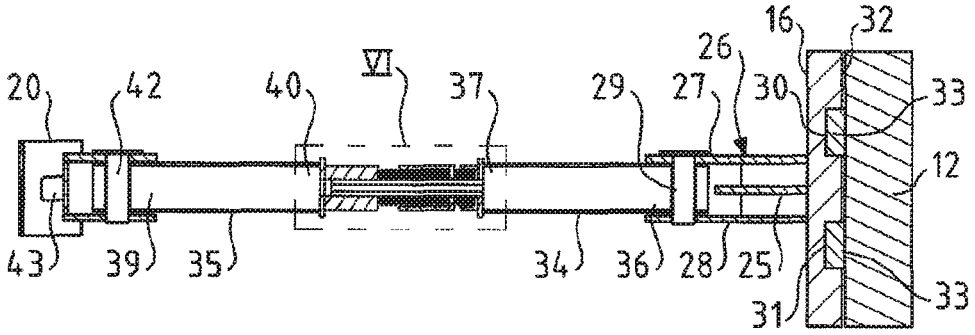
FIG. 5 is a sectional view in the axis V-V in FIG. 4 illustrating the securing arm and the collar of the securing device.

As visible in FIG. 5, the collar 16 contains an upper groove 30 and a lower groove 31 on an internal face 32. Suchlike grooves 30 and 31 develop in the radial thickness of the collar 16. The upper groove 30 is situated above the ring 25, and the lower groove 31 is situated below the ring 25. These grooves 30 and 31 develop in a circular manner on all or part of the internal circumference of the collar 16. A wedge 33 is housed in each groove 30 and 31. A suchlike wedge 33 is produced from a polymer material, for example from high-density polyethylene or from polytetrafluoroethylene. Each wedge 33 is in bearing contact between the collar 26 and the end 13 of the pumping pipe 12 on which the collar 16 is mounted. The wedges may be secured by gluing, screwing and other appropriate methods.

The pumping pipe 12 contracts in the course of a change in the temperature in the tank, for example in the course of loading LNG at −162° C. During this contraction, which represents a contraction in the order of 87 mm for a pumping pipe of 30 m in length, the securing of the collar 16 on the pumping pipe 12 may be compromised by the vertical displacement due to the thermal contraction of the pumping pipe 12. As a consequence, the collar 16 may no longer be maintained on the pumping pipe 12 in a stable manner. Suchlike wedges 33 made from a polymer material permit a sliding support of the collar 16 on the pumping pipe 12, the collar thus being maintained in a secured position in the level of the sump on the pumping pipe 12 by means of these wedges 33. In the case of an anti-rotation system of the kind described above with respect to FIG. 11, each of the metallic wedges 61 and 62 of the anti-rotation system exhibits a radial thickness smaller than the radial thickness of the wedges 33 and, more specifically, smaller than the distance separating the internal face 32 from the pumping pipe 12.

Given that the four securing arms 17 of the securing device 15 are similar, a single securing arm 17 is described below with respect to FIGS. 4 to 6.

The securing arm 17 contains a proximal arm portion 34 and a distal arm portion 35. These arm portions 34 and 35 are formed by aligned hollow rigid rods.

A first end 36 of the proximal arm portion 34 contains a pin 29 collaborating with the lug 26. A second end 37 of the proximal arm portion 34 collaborates with a central portion 38 of the securing arm 17 described below with respect to FIG. 6 and containing a telescopic structure associated with the elastic member 18.

The distal arm portion 35 contains a first end 39, on which there is mounted the pad 19 capable of rotation about an axis parallel to a generatrix direction of the collar 16. A second end 40 of the distal arm portion 35 collaborates with the central portion 38 of the securing arm 17.

The pad 19 contains a main body 41 bearing a pin 42 housed in a hub of the first end 39 of the distal arm portion 35. A first spacer 43 develops from the main body 41 of the pad 19, the first bearing surface 20 being mounted on an end of the first spacer 43 opposite the main body 41. A second spacer 44 develops from the main body 41 of the pad 19, the second bearing surface 20 being mounted on an end of the second spacer 44 opposite the main body 41. The first spacer 43 and the second spacer 44 develop perpendicularly one to the other. Each bearing surface 20 develops in a plane perpendicular to the direction of development of the spacer on which it is mounted. The pads are made from metal in order to collaborate with the lateral walls 9 of the rigid container 7 with friction, thereby offering improved support of the pads 19 on the lateral walls 9.

In the case of a rigid container 7 made from thick sheets, the pads 19 may exhibit abutment surfaces 20 of square, round, planar or cylindrical form and exhibiting characteristic dimensions, for example in the range between 5 cm and 50 cm.

In an embodiment in which the container is not as rigid and exhibits a more fragile structure, for example containing a fine primary fluid-tight membrane supported by a thermally insulating barrier, materials other than insulating foam may be installed in the primary thermally insulating barrier at the level of the abutment zones of the pads 19. Thus, the lateral walls 9 of the container may be reinforced by the installation of laminate or composite material. In this case, the abutment surfaces of the pads may exhibit a square form having a side length of 20 cm in order to withstand loads in the order of 17,000 N, or also having a side length of 30 cm in order to withstand loads of 40,000 N. However, in the case of a fluid-tight membrane exhibiting corrugations, the abutment surfaces 20 exhibit dimensions that are limited by the distance separating two successive corrugations. The securing device 15 thus makes it possible to install the abutment surfaces 20 outside individual zones of the membrane, for example between two corrugations in the case of a corrugated primary fluid-tight membrane 5.

Figure 6:
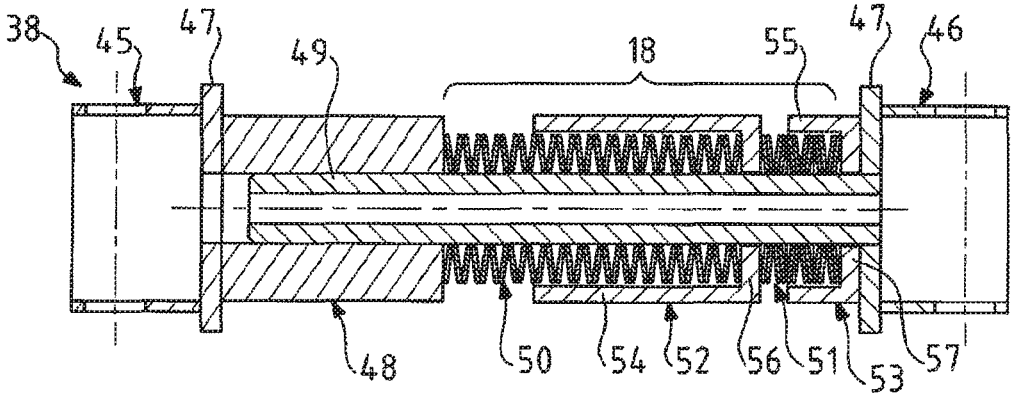
FIG. 6 is an enlarged view of the zone VI in FIG. 5.

FIG. 6 illustrates a sectional view in detail of the central portion 38 of the securing arm 17 in FIG. 5. The central portion 38 contains a distal sleeve 45 and a proximal sleeve 46. Each sleeve 45, 46 exhibits a cylindrical form, of which the diameter is smaller than the diameter of the arm portion with which it collaborates. Furthermore, each sleeve 45, 46 contains an upper orifice and a lower orifice facing one another. Likewise, the second end 37, 40 of each arm portion contains an upper orifice and a lower orifice facing one another. Each sleeve 45, 46 contains in addition a shoulder 47 projecting on its periphery. The distal sleeve 45 is inserted by sliding into the second end 40 of the distal arm portion 35 as far as an abutment of said second end 40 against the shoulder 47 of the distal sleeve 45. In this position in abutment, the orifices of the second end 40 of the distal arm portion 35 face towards the orifices of the distal sleeve 45, such that a pin 58 (see FIG. 4) may be inserted into these orifices in order to lock the distal arm portion 35 and the central arm portion 38 in position. The second end 37 of the proximal arm portion 34 and the proximal sleeve 46 function in a similar manner in order to lock the proximal arm portion 37 and the central arm portion in position 38.

The distal sleeve 45 contains a cylindrical guide tube 48 developing coaxially with the distal sleeve 45 and exhibiting a hollow internal portion. The proximal sleeve 46 contains a guide rod 49 developing coaxially with the proximal sleeve 46 and complementary to the hollow portion of the guide tube 48. The guide rod 49 is inserted into the hollow portion of the guide tube 48 in such a way as to permit guiding by sliding between the distal sleeve 45 and the proximal sleeve 46.

Figure 8:
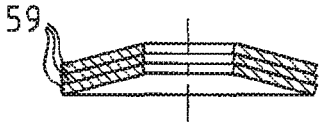
FIGS. 8 to 10 illustrate different methods of mounting the Belleville washers of the elastic elements.
Figure 9:
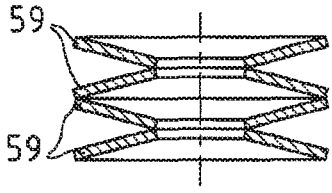
Figure 10:
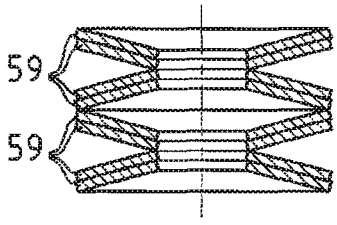

The elastic member 18 is supported by the guide rod 49. Typically, the elastic member contains a plurality of Belleville washers 59 mounted on the guide rod 49. The Belleville washers 59 illustrated in FIG. 6 are mounted in series, that is to say according to a mounting as illustrated in FIG. 9. However, these Belleville washers 59 could be mounted in parallel, as illustrated in FIG. 8, or according to a mounting involving a combination of the mounting in series and the mounting in parallel, as illustrated in FIG. 10. The elastic member 18 in the embodiment illustrated in FIG. 6 contains a first group of Belleville washers 59 forming a more flexible first elastic element 50 and a second group of Belleville washers 59 forming a more rigid second elastic element 51.

The guide rod 49 in addition supports a first compression limiter 52 and a second compression limiter 53. Each compression limiter 52, 53 contains a hollow cylindrical portion, respectively 54 and 55, having a diameter that is larger than the diameter of the Belleville washers 59 closed at one of its ends by a bottom, respectively 56 and 57.

The first group of Belleville washers 59 is supported between a radially internal face of the guide tube 48 and the bottom 56 of the first compression limiter 52. The cylindrical portion 54 of the first compression limiter 52 surrounds a part of the Belleville washers 59 of said first group of Belleville washers 59.

The second group of Belleville washers 59 is interposed between the bottom 56 of the first compression limiter 52 and a bottom 57 of the second compression limiter 53. The cylindrical portion 55 of the second compression limiter 53 surrounds a part of the Belleville washers 59 of the second group of Belleville washers 59.

The first elastic element 50 exhibits a rigidity lower than the rigidity of the second elastic element 51.

In a variant embodiment, the central portion 38 is mounted in the other direction, the rod 49 then being present on the side of the distal arm portion 35. A description will now be given of the operation of the securing device 15.

When the pump of the pumping pipe 12 is in operation, it generates vibrations of the end 13 of the pumping pipe 12. These vibrations are transmitted to the securing arms 17 by means of the collar 16. The first flexible elastic element 50 permits the absorption of the forces of low intensity caused by these vibrations of the pump in the pumping pipe 12. A suchlike first flexible elastic element 50 thus avoids the transmission of the vibrations generated by the pump from the pumping pipe 12 to the rigid container 7 and to the primary fluid-tight membrane 5 by means of the securing arms 17.

Conversely, during high stresses, for example associated with an earthquake in the case of a shore-based tank or under the effect of the swell in the case of a tank installed in a ship, forces of high intensity may be transmitted to the securing arms 17. These forces of high amplitude cannot be absorbed by the first flexible elastic element 50, which is compressed within the limit authorized by the first compression limiter 52. Typically, the Belleville washers 59 of the first group of Belleville washers 59 are compressed until the cylindrical portion 54 of the first compression limiter 52 comes into abutment against the guide tube 48, thereby preventing the supplementary compression of the first group of Belleville washers 59. The second, more rigid elastic element 51 then permits the absorption of these high-amplitude forces. The second group of Belleville washers 59 is compressed in turn and absorbs these high-amplitude forces.

Thus, the elastic members 18 of the securing arms 17 enable the end 13 of the pumping pipe 12 to be secured, while absorbing forces of different intensities between the rigid container 7 and the pumping pipe 12 in an elastic manner.

The rigidity of the elastic elements 50, 51 is advantageously selected depending on the order of magnitude of the envisaged displacements. Thus, depending on the envisaged displacements and also on the available length to the elastic member 18 in the rigid container 7, elastic elements may be proposed exhibiting a rigidity lying within a range from 300 N/mm to 8,000 N/mm, preferably between 500 and 5,000 N/mm.

Furthermore, the rigidity of the elastic elements 50, 51 is preferably selected so as to withstand the worst envisaged conditions, for example in response to an earthquake in the case of a tank full of liquid and of a pumping pipe 12 likewise full of liquid. In an illustrative embodiment, the elastic member 18 is configured to withstand an acceleration of 1 g in a given direction, which may generate a reaction force in the order of 34 kN that the elastic member must be able to absorb. These assumptions include the possibility, for example, of installing a second elastic element 51 exhibiting a rigidity in the order of 1,000 N/mm in order to achieve displacements in the range between 8 mm and 37 mm.

The technique described above may be utilized for securing any type of pipe in different types of reservoirs, for example for a tank of an LNG reservoir in a shore-based facility or in a floating structure such as an LNG carrier or the like.

Figure 7:
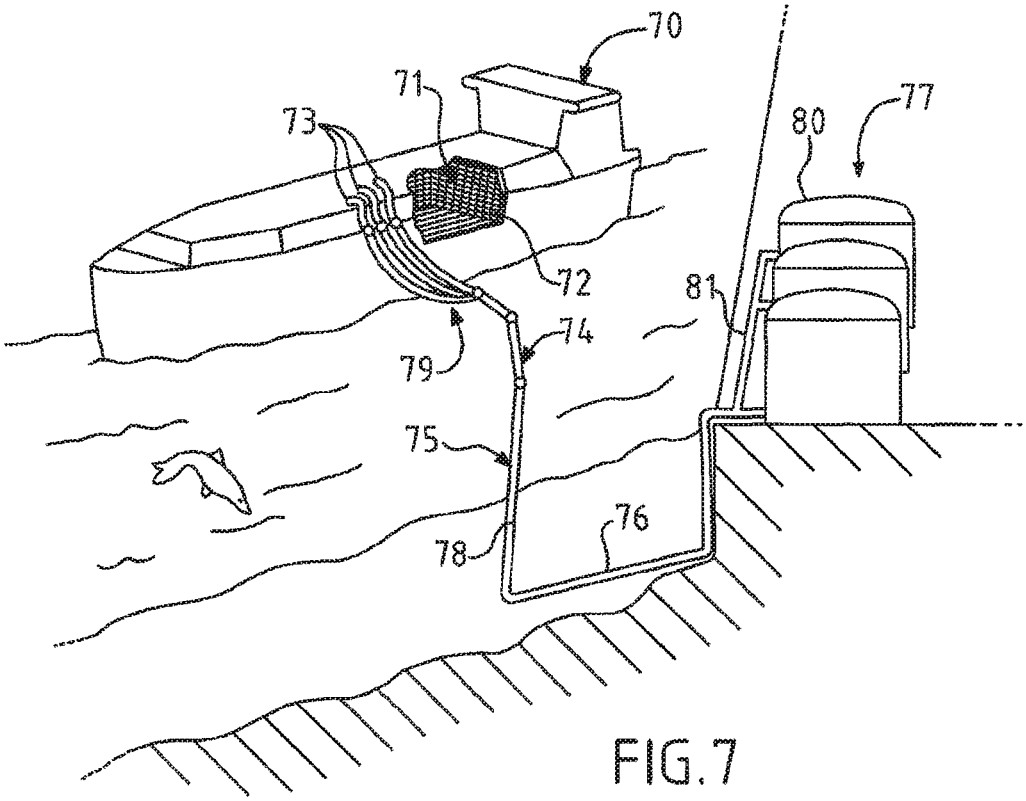
FIG. 7 is a cut-away schematic representation of a tank of an LNG carrier containing a thermally insulating and fluid-tight tank associated with a terminal for the loading/unloading of this tank.

With reference to FIG. 7, a cut-away view of an LNG carrier 70 depicts a fluid-tight and insulating tank 71 of generally prismatic form mounted in the double hull 72 of the ship. The wall of the tank 71 contains a primary fluid-tight barrier intended to be in contact with the LNG contained in the tank, a secondary fluid-tight barrier arranged between the primary fluid-tight barrier and the double hull 72 of the ship, and two insulating barriers arranged respectively between the primary fluid-tight barrier and the secondary fluid-tight barrier and between the secondary fluid-tight barrier and the double hull 72.

In a manner known per se, loading/unloading pipes 73 disposed on the upper deck of the ship may be connected, by means of appropriate connectors, to a maritime terminal or a port terminal for transferring a cargo of LNG from or towards the tank 71.

FIG. 7 represents an example of a maritime terminal containing a loading and unloading station 75, a submarine pipe 76 and a shore-based facility 77. The loading and unloading station 75 is a secured off-shore facility containing a mobile arm 74 and a tower 78 which supports the mobile arm 74. The mobile arm 74 carries a bundle of insulated flexible hoses 79 capable of being connected to the loading/unloading pipes 73. The orientable mobile arm 74 adapts to all sizes of LNG carriers. A connecting pipe, which is not represented here, extends to the interior of the tower 78. The loading and unloading station 75 permits the loading and the unloading of the LNG carrier 70 from or towards the shore-based facility 77. The latter contains tanks for the storage of liquefied gas 80 and connecting pipes 81 connected by the submarine pipe 76 to the loading or unloading station 75. The submarine pipe 76 permits the transfer of the liquefied gas between the loading or unloading station 75 and the shore-based facility 77 over a large distance, for example 5 km, which permits the LNG carrier 70 to be kept at a large distance from the shore during the loading and unloading operations.

Pumps carried on board the ship 70, for example in the pumping pipe 12, and/or pumps equipping the shore-based facility 77 and/or pumps equipping the loading and unloading station 75 are used in order to generate the pressure necessary for the transfer of the liquefied gas.

Although the invention is described above in conjunction with a plurality of particular embodiments, it is obvious that it is not limited in any way in this respect and that it comprises all the technical equivalents of the means described here as well as their combinations, if the latter fall within the scope of the invention.

The usage of the verb "contain", "comprise" or "include" and its conjugated forms does not exclude the presence of elements or stages other than those set out in a claim. The use of the indefinite article "a" or "an" for an element or a stage does not exclude the presence of a plurality of suchlike elements or stages, unless otherwise stipulated.

In the claims, any reference mark in parentheses should not be interpreted as a limitation of the claim.

The invention claimed is:

1. A fluid storage facility containing a fluid-tight and insulating tank, in which a bottom wall (6) of the tank contains a housing (7), and a loading or unloading pipe (12) arranged in the tank, one end (13) of the pipe being accommodated in the housing, the facility containing in addition a securing device for securing the pipe (12) in the housing (7), the securing device containing:

a cylindrical collar (16) mounted on the end (13) of the pipe, at least three securing arms (17), each securing arm containing a proximal arm portion (34) containing a first end (36) mounted on the cylindrical collar, the proximal arm portion being capable of rotation about a first axis of rotation parallel to a generatrix direction of the cylindrical collar, a distal arm portion (35) containing a first end (39) bearing a bearing pad (19), the bearing pad being mounted on said first end of the distal arm portion, the bearing pad being capable of rotation about a second axis of rotation parallel to the generatrix direction of the cylindrical collar, the bearing pad containing a bearing surface (20) facing away from the collar and collaborating with a wall (9) of the housing (7), in which at least one of said securing arms contains a guideway (48, 49) coupling the proximal arm portion to the distal arm portion and capable of translationally guiding the distal arm portion with respect to the proximal arm portion in an axis of displacement perpendicular to the generatrix direction of the collar, an elastic member (18) being coupled to the guideway so as to be able to apply a return force that pushes the distal arm portion away from the proximal arm portion in the axis of displacement in response to a stress aimed at moving the distal arm portion closer to the proximal arm portion.

2. The fluid storage facility as claimed in claim 1, in which the securing arms extend perpendicularly to the generatrix direction of the collar.

3. The fluid storage facility as claimed in claim 1, in which the guideway of said at least one of the securing arms contains:

a hollow guide tube (48) secured to a second end (40,37) of one or other of the distal arm portion and the proximal arm portion, said guide tube developing in the alignment of said one or other of the distal arm portion and the proximal arm portion, a guide rod (49) secured to a second end (40,37) of the other of the distal arm portion and the proximal arm portion, the guide rod developing in the alignment of said other of the distal arm portion and the proximal arm portion, the guide rod being slidably mounted in the guide tube in the axis of displacement.

4. The fluid storage facility as claimed in claim 3, in which the elastic member of said at least one of the securing arms contains a plurality of elastic washers engaged on the guide rod and bearing, on the one hand, on an end surface of the guide tube (48) and, on the other hand, on an abutment surface that said other of the distal arm portion and the proximal arm portion contains.

5. The fluid storage facility as claimed in claim 1, in which the elastic member of said at least one of the securing arms contains a first elastic element (50) and a second elastic element (51) mounted in series between the distal portion and the proximal portion of said securing arm, and in which the first elastic element exhibits a first rigidity and the second elastic element exhibits a second rigidity that is higher than the first rigidity.

6. The fluid storage facility as claimed in claim 1, in which the cylindrical collar is made from metal, the securing device containing in addition a sliding block (33) made from a polymer material mounted on an internal face (32) of the cylindrical collar and supported on the end of the pipe.

7. The fluid storage facility as claimed in claim 6, in which the internal face of the cylindrical collar exhibits a groove (31) developing in the radial thickness of the cylindrical collar perpendicularly to the generatrix of the cylindrical collar, the sliding block (33) being accommodated in said groove and projecting radially towards the interior beyond the internal face of the cylindrical collar.

8. The fluid storage facility as claimed in claim 7, in which the groove develops in an annular manner about the generatrix direction of the cylindrical collar.

9. The fluid storage facility as claimed in claim 1, in which the bearing pad (19) of at least one of the securing arms contains:

a first plane bearing surface (20) developing in a first plane parallel to the director of the cylindrical collar, and a second plane bearing surface (20) developing in a second plane parallel to the director of the cylindrical collar, the first plane and the second plane being secant.

10. The fluid storage facility as claimed in claim 1, in which the cylindrical collar contains a first half cylinder (23) and a second half cylinder (23) secured together and jointly forming the cylindrical collar.

11. The fluid storage facility as claimed in claim 1, in which the collar contains a shoulder (25) projecting radially towards the exterior from an external face of the cylindrical collar, each securing arm being mounted on the shoulder.

12. The fluid storage facility as claimed in claim 1, containing in addition a pump housed in the pipe, said pump being capable of loading or unloading a fluid respectively into or from the housing.

13. A ship (70) for the transport of a cold liquid product, the ship containing a double hull (72) and a fluid storage facility (71) as claimed in claim 1, in which the tank is disposed in the double hull.

14. A method of loading or unloading a ship (70) as claimed in claim 13, in which a cold liquid product is conveyed through the pipe (12) from or towards a second floating or shore-based storage facility (77) towards or from the tank of the ship (71).

15. A transfer system for a cold liquid product, the system containing a ship (70) as claimed in claim 13, the pipe (12) being so arranged as to connect the tank (71) installed in the hull of the ship to a second floating or shore-based storage facility (77) and a pump for conveying a flow of cold liquid product through the pipe (12) from or towards the second floating or shore-based storage facility towards or from the tank of the ship.

* * * * *